United States Patent [19]

Kobler et al.

[11] Patent Number: 5,074,212

[45] Date of Patent: Dec. 24, 1991

[54] AUTOMATIC PRINTING PLATE ATTACHING SYSTEM

[75] Inventors: Ingo Kobler, Anhausen; Oskar Liebert, Neusäss, both of Fed. Rep. of Germany

[73] Assignee: Man Roland Druckmaschinen AG, Offenbach am Main, Fed. Rep. of Germany

[21] Appl. No.: 644,212

[22] Filed: Jan. 22, 1991

[30] Foreign Application Priority Data

Feb. 6, 1990 [DE] Fed. Rep. of Germany ..... 4003445

[51] Int. Cl.[5] ..... B41F 27/12; B41U 29/14

[52] U.S. Cl. ..... 101/477; 101/415.1

[58] Field of Search ..... 101/477, DIG. 36, 415.1, 101/378, 136–138, 141, 142, 144, 378, 52–54, 232; 414/267, 268, 270, 354; 33/613, 621

[56] References Cited

U.S. PATENT DOCUMENTS 4,727,807 3/1988 Suzuki et al. ..... 101/415.1

FOREIGN PATENT DOCUMENTS 62-74654 4/1987 Japan ..... 101/415.1

*Primary Examiner*—J. Reed Fisher

*Attorney, Agent, or Firm*—Frishauf, Holtz, Goodman & Woodward

[57] ABSTRACT

A carriage (1*a*) which supports a storage container (1) for holding a plurality of printing plates is movable in a path along the printing stations (101, 102, 103) of the rotary printing machine system; guide paths (4) extend parallel to the axes of rotation of plate cylinders (104 . . . 109) and plate handling apparatus (3) to apply or remove printing plates are movable between the plate cylinders (e.g. 105, 106) of neighboring printing stations. The plate handling apparatus removes printing plates after the carriage (1*a*) is moved to a plate pick-up position (121 . . . 124), applies the plate on the respective plate cylinder (e.g. 106), removes a used or old printing plate from another plate plate cylinder, if desired, and returns it back to the storage container on the carriage. The movement of the carriage can be controlled by a guide system (2*a*), and run along a fixed rail track, or guided by induction or radiation.

13 Claims, 3 Drawing Sheets

AUTOMATIC PRINTING PLATE ATTACHING SYSTEM

FIELD OF THE INVENTION

The present invention relates to rotary printing machines, and more particularly to a system to automatically pick out a selected printing plate from a supply carriage, movable along the length of a multi-station printing machine, and then transfer the printing plate to a handling apparatus which can apply the printing plate to the printing cylinder of a printing machine, and remove a previously used printing plate for return to the carriage.

BACKGROUND

Printing machine plate handling and mounting and removal apparatus are known, see for example, German Patent Disclosure Document DE-OS 36 30 876. This apparatus has a printing plate transport carrier which is movable along a transport path, to supply the printing plates to the printing station. A transport track is provided to transport previously used printing plates after they have done their printing jobs, to a removal and recycling or disposal point. Each one of the printing stations is associated with a robot apparatus which, based on control information supplied thereto, secures the printing plates to the respectively commanded plate cylinders of the printing stations and, after printing, again removes the printing plates from the plate cylinder. This structure has a disadvantage in that the printing plates to be applied by the robot apparatus cannot be picked up directly by the apparatus from a plate transport system; rather, a separate printing plate unloading apparatus must be associated with each one of the printing stations, which picks out printing plates from a plate transport carrier, transports them to a plate auxiliary carrier which passes along or around the printing station. Only then, and at a predetermined position, can the robot apparatus pick up a printing plate. The multiple loading, reloading and change of carriers to which any printing plate must be objected upon plate change, as well as the number of the respective apparatus units which all handle the plate, require substantial control apparatus and control program capability as well as programming time; the apparatus which are programmed and controlled, due to their multiple functions and the multiple handling of the printing plate, are subject to malfunction, which interferes with smooth plate changing and printing of subject matter.

In newspaper work, particularly, a substantial number of printing plates must be applied to a printing machine under time pressure. Rotary printing machines, as customarily used in newspaper work, are highly labor-intensive with respect to plate changing. Due to the time pressure, which is occasioned by the desire to print the latest news as quickly as possible, the printing plates are frequently ready only very shortly before printing is to commence. If late-breaking news is present, printing may have to be interrupted and a plate changed quickly for another one.

THE INVENTION

It is an object to provide an automatic printing plate supply and attachment system to supply and attach printing plates on a rotary printing machine and remove and return used or old printing plates, which permits automatic supply of the printing plates to a handling apparatus in minimum time, with a minimum of system components and apparatus elements.

Briefly, a movable carriage retains thereon a storage container to hold a plurality of printing plates. The movable carriage is movable in a carriage path which extends at right angles to a handling apparatus guide path. The handling apparatus guide path is parallel to the axes of rotation of plate cylinders of printing stations of a multi-station printing machine.

The system has the advantage that application of printing plates to the plate cylinders of multi-station printing machines can be effectively entirely, or at least largely automated. This not only is economical of personal and operator efforts but, further, permits delivery of printing plates to a printing cylinder at the last possible moment, and thus in time when plates must be ready for printing.

In accordance with a preferred feature of the invention, the carriage is guided along a carriage path which extends longitudinally past the respective printing stations of a multi-station printing machine, and the handling apparatus is guided in a guide path between the printing station so that one handling apparatus can apply printing plates to various printing cylinders of, for example, printing stations located at opposite sides of the respective guide path. The handling apparatus can be constructed to be more simple and a plurality of handling apparatus units can be provided, one each between a pair of printing stations. This has the advantage that substantial time can be saved in applying printing plates rather than, in accordance with the prior art, providing a single printing plate application apparatus which also was much more complex. Further, by providing a plurality of handling apparatus units, a plurality of printing plates can be applied simultaneously to respective plate cylinders. The stop, or down time of the printing machine, thus, can be reduced to a minimum.

DRAWINGS

DETAILED DESCRIPTION

Figure 1:
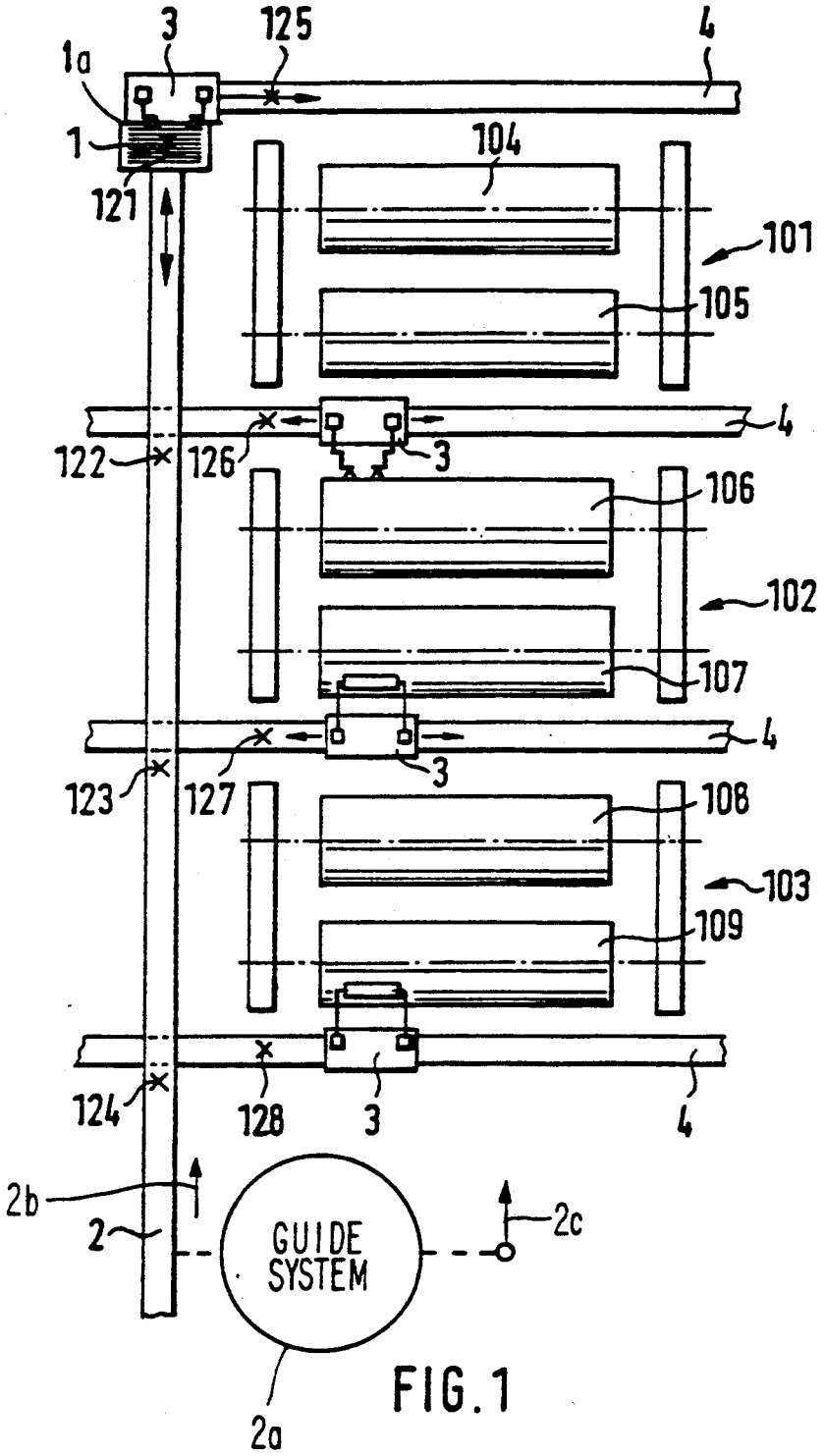
FIG. 1 is a schematic top view of a printing plate supply and cylinder application system.

Referring first to FIG. 1:

A printing machine system has printing stations 101, 102, 103 . . . ; each one has a plurality of plate cylinders, for example plate cylinders 104, 105; 106, 107; 108, 109. A carriage 1*a* supports thereon a storage box or container 1 which holds a plurality of printing plates. The carriage 1*a* is movable directly from a printing plate composing room—not shown—to a guide path 2 which extends along the printing machine system at the outer edge of the printing stations 101, 102, 103 . . . The guide path includes destination stops or destination points 121, 122, 123, 124. The guide path 2 can be defined either by rail tracks, or can be defined by a guide system schematically shown at 2*a*. This guide system can operate non-mechanically, that is, by defining a guide path by a beam of radiation shown, schematically, by arrow 2*b*. The radiation may be electromagnetic radiation, like a guide beam for an aircraft landing system; an infrared light beam; a laser beam; an ultrasonic beam, or the like. These beams can be modulated to carry control information derived from the guide system 2a to transmit to the carriage 1a, stop-and-go information, or a movement program, to control movement of the carriage 1a to the respective destination point 121 . . . 124 . . . Of course, the tracks may be rails or, for example, may include an induction guide rail, wire, or the like. The guide system transmits this information to the carriage 1a, as schematically shown by arrow 2c, either at the beginning of travel or, if desired, to change the stopping points or the movement program even while the carriage 1a is moving along the schematically shown path 2.

The carriage 1a is supplied with the usual receivers, capable of receiving the type of radiation or data transmitted by the guide system 2a, for example in accordance with the guide path 2b, as well as suitable storage memory apparatus for recording, evaluating, and then acting on information fed thereto initially and, if appropriate, changed, for example by the data transmitted as shown by the arrow 2c.

In accordance with a feature of the invention, a plurality of handling apparatus units 3 are provided, located between adjacent printing machine systems 101, 102, 103, as well as at the outer edge of the most remote printing systems, for example adjacent printing cylinder 104 of printing system 101. The handling apparatus 3 is constructed to be capable of removing a printing plate from the storage container 1 on the carriage 1a or, respectively, place a previously used, hereinafter "old", printing plate into the storage container 1. The handling apparatus is movable along a guide path 4 which extends at essentially right angles to the carriage path 2, and further is essentially parallel to the axes of rotation of the respective plate cylinders.

BASIC OPERATION

The storage container 1 on the carriage 1a has printing plates for a printing job to be printed supplied thereto. The carriage 1a is then controlled to move to a respective plate exchange position 121, 122 . . . The handling apparatus 3 is caused to move to the respective station and, after the handling apparatus 3 has removed a printing plate therefrom, it moves along the respective path in a horizontal direction—with respect to FIG. 1. Control of movement along the respective path 4 can be in accordance with any well known positioning control apparatus, for example opto-electronic sensors, selectively engageable and disengageable abutments or stops, or the like.

The printing plate on the apparatus 3 is then applied to a selected predetermined plate cylinder, for example cylinder 106 (FIG. 1). If a printing plate is to be removed from a cylinder, it moves into the respective cylinder position—unless it was there already—picks up the printing plate therefrom, and then carries it to the respective waiting position or station where the carriage 1a is programmed to receive the old printing plate.

When all the printing plates in the carriage 1a which are to be placed on cylinders have been picked up by the respective handling apparatus units 3, and/or the old printing plates returned thereto, the carriage 1a can return to the original starting position, for example a composing room, to permit the old plates to be removed, for further handling, for example re-use, re-application of new subject matter, or the like, and loading of new printing plates on the carriage 1a.

As will appear in detail below, the handling units 3 can operate between two printing stations and thus remove or apply plates on plate cylinders of two neighboring printing stations. Further, the carriage 1a can, in a single loading receive printing plates for different printing cylinders in respectively different printing stations. If this mode of operation is desired, the carriage preferably first goes to the first or closest destination point, waits for the handling apparatus to pick up the printing plate which is needed, then proceeds to the second destination point to permit the next printing plate to be removed, and so on, and then returns to the original starting point or, respectively, returns to for example the first unloading point in order to receive from printing systems thereat the old printing plates which had, in the meanwhile, printed subject matter therefrom; the carriage can then proceed to a further destination in order to receive additional old printing plates, and so on.

Of course, the delivery and pick-up cycle and the respective delivery and pick-up steps can follow each other in any desired sequence; there is no requirement that the delivery step and old plate pick-up steps are grouped in specific sequences. It is also possible to so arrange the system that the destination points at which the carriage is to stop can be changed as the carriage is moving, for example under control of signals as schematically shown by arrow 2c, derived from the guide system 2a.

Figure 2:
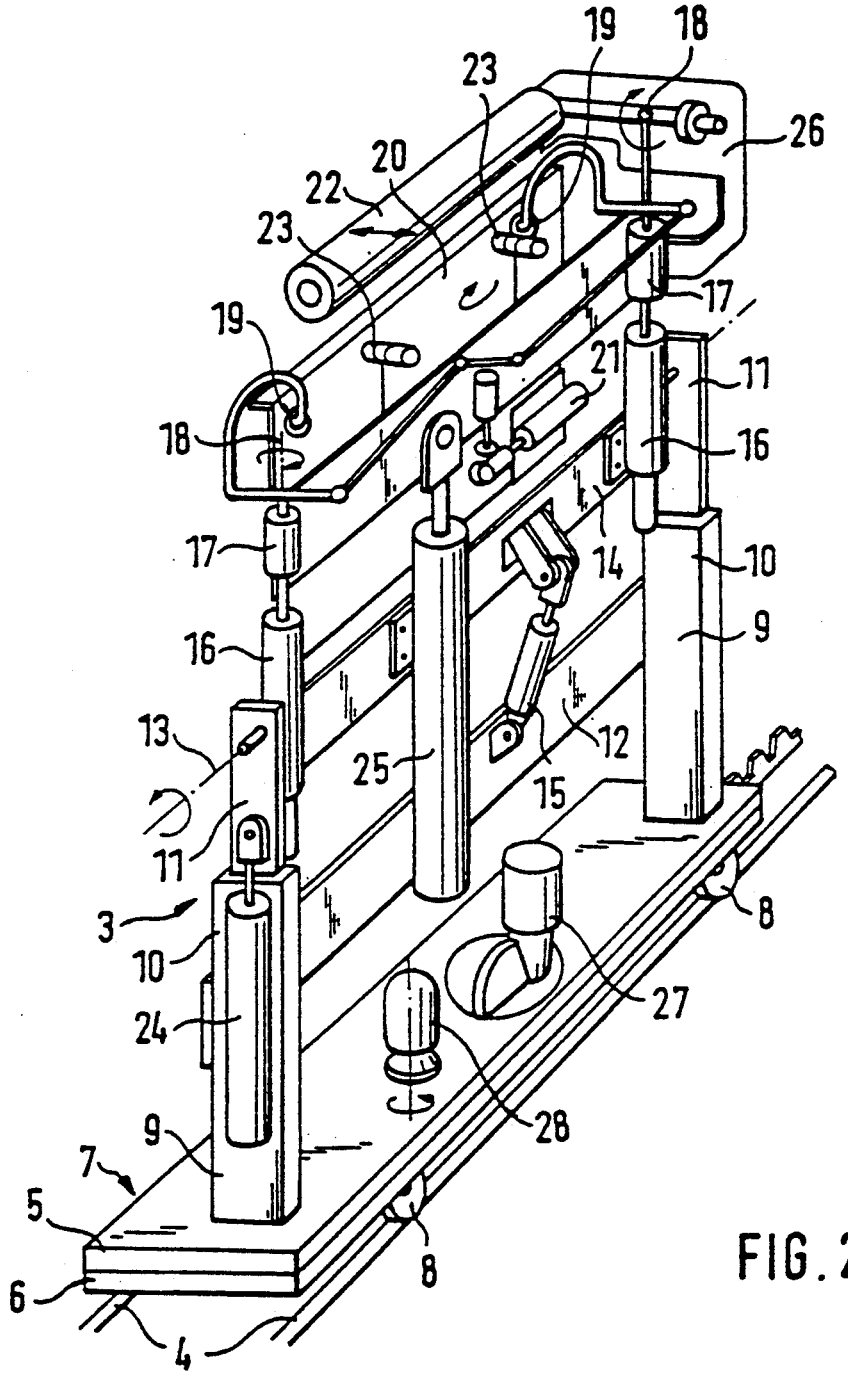
FIG. 2 is a highly schematic detail view of a handling apparatus for printing plates to apply a plate on a plate cylinder.

A handling apparatus 3, suitable to remove printing plates from the storage container 1, apply them to a printing cylinder, remove printing plates from a cylinder and return them to the storage container 1 is seen, schematically, in FIG. 2.

In accordance with a feature of the present invention, the apparatus 3 has two plate elements 5, 6, which can be rotated relative to each other about a common vertical axis. The plates 5, 6 form a chassis. Rollers or wheels 8 are secured to the lower plate 6, to run, for example, on rails, which may include a rack for control, and forming the guide path 4. The guide path 4 need not include rails, and/or rack elements but, rather, the wheels 8 may be rollers or other suitable structures, or the guide path can be formed by a transport belt, transport chain or the like, in order to move the unit 3, for example in form of a pallet on a transport belt or similar belt system.

The upper plate element 5 of the chassis 7 supports two telescopic legs 9 which extend vertically upwardly, forming a lower fixed outer telescopic element 10, secured to the plate 5, within which an upwardly movable telescopic element 11 is slidably located. The outer telescopic elements 10 are cross-connected by a plate 12. The inner telescopic elements 11 are coupled to a rocking plate 14, which can be pivoted about a horizontal pivot axis 13. A rocking or pivoting system 15, secured to the cross plate 12 and, for example, and as shown, forming a piston-cylinder element, can pivot the plate 14 about pivot stubs pivotable about axis 13. The plate 14 is further connected to an apparatus 16 to pick up and guide a plate holder mechanism 17. The height or level position of the plate holder mechanism 17 is adjustable. The plate holder mechanism 17 has two suction grippers 19, which are freely supported, generally of tubular form, and respectively rotatable about an axis of rotation shown by the axis arrow 18. The suction grippers 19 are used to grip and hold a printing plate 20 which is to be handled. A suction grip rotary drive unit 21, secured to the cross support element 14 and located thereabove, rotates the suction grippers 19. A presser roller 22 is resiliently rotatably retained in an end shield 26. The presser roller 22, likewise, can be rotated about the axis 18; its axis of rotation is parallel to the plate cylinder with which the unit 3 is to cooperate. It is provided to press a printing plate 20 on the respective plate cylinder. Two plate removal units 23 are provided, to loosen and remove a printing plate from a plate cylinder.

OPERATION

Printing plates 20 usually have a leading and trailing bent-over edge portion. To apply such a printing plate with a leading and trailing bent-over end portion on a plate cylinder, the printing plate 20 is brought in the respective required height or level position by moving the telescoping legs 9, 10, 11 to the appropriate level. A first telescoping drive 24 operates the raising and lowering of the telescopic system 9, 10, 11. For structural reasons, the plate cylinder in most printing machines is somewhat inwardly of the side wall contour of the respective printing station. To reach the plate cylinder, the plate holder mechanism 17 is moved by the pivoting or rocking or tilting drive 15 about the pivot or rocking axis 13. The plate holding mechanism 17 can now be moved, at an inclined direction, to the appropriate position by the second telescoping drive 25, which is secured to the plate 14 and the plate holders 17, respectively. This is shown, schematically, in FIG. 3 at positions 3*a* and 3*b* for respective plate cylinders 105 and 111. The plate cylinder 105, 111, respectively, is then rotated in a position in which the leading plate edge or end portion of the printing plate can be pressed into the rapid clamping position of the plate cylinder. The vacuum of the suction gripper 19 is then released and the suction gripper 19 is rotated away by operating the drive 21 and rotating the grippers about the axis 18. Upon rotation of the plate cylinder, the presser roller 22 will press the plate 20 on the plate cylinder so that the plate 20 will be rolled on, and at the trailing portion, the trailing angled-off end is pushed into the plate stretching rail, which automatically grips and holds the printing plate 20 on the plate cylinder. The plate, thus, has been applied on the plate cylinder, and the plate holder mechanism 17, including the pivoting or rocking carrier 18, is moved again into vertical position by reversing the movement of the rocking or tilting cylinder-piston unit 15. The telescoping system 25 can return the projected position to the position shown in FIG. 2.

Figure 3:
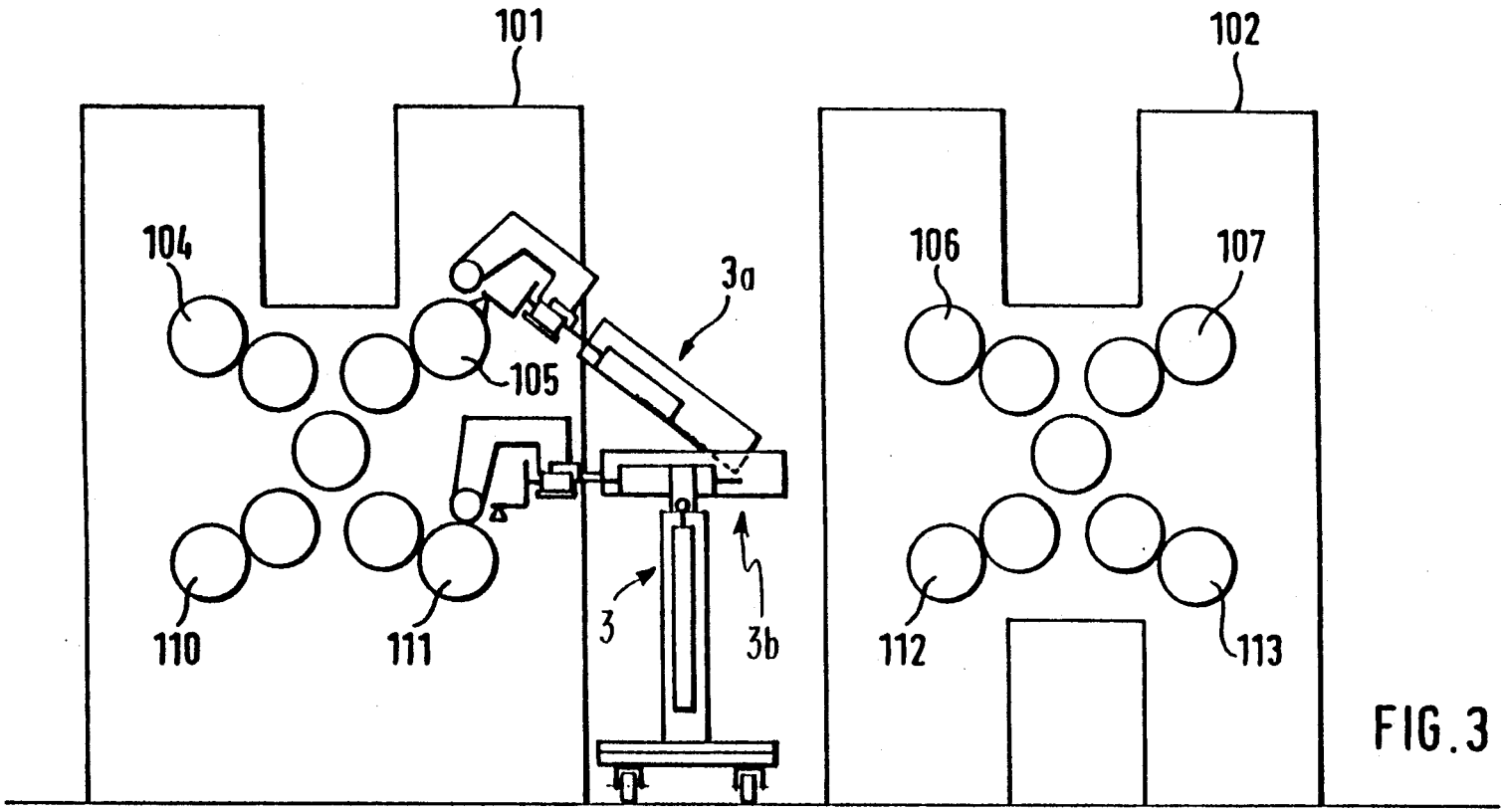
FIG. 3 is a highly schematic side view of a two-station printing machine system and illustrating application of printing plates on plate cylinders of two neighboring printing stations by one handling apparatus unit.

The unit 3 has its own drive system 27, shown schematically as a motor coupled to a drive wheel; any other drive system, or for example an externally coupled chain or rack may be suitable. By operating the drive system 27, the unit 3 is moved into other positions, for example other "ready" positions 125, 126, 127, so that, as soon as the carriage 1*a* appears at the appropriate stopping position 121, 122 . . . 124 . . ., it can be rapidly moved to the carriage, to operate the suction grippers 19 and pick up a new printing plate from the storage container 1. If, now. the next printing plate is to be applied to a plate cylinder opposite the one previously handled, the upper portion of the unit 3 secured to the plate 5 is rotated by operating the motor 28, whereupon the plate handling unit 17 will be facing in the opposite direction and the entire above-described process can be repeated with respect to an oppositely positioned printing cylinder, for example printing cylinders 106, 112 (FIG. 3).

PLATE REMOVAL

To remove a printing plate, the suction grippers have suction applied thereto and the plate removal elements 23 press against the plate holding rails of the plate cylinder. This releases one end of the printing plate 20 from the plate cylinder, and the printing plate will, resiliently, snap outwardly, to be gripper by the suction grippers 19 and held there by vacuum. The so-held plate can then be returned to the storage container 1 of the carriage 1*a*.

The system has an important advantage: The printing machine stations, for example for newspaper printing, usually are offset printing stations which have inkers and dampers. The apparatus is compact, and takes into consideration the limited accessibility of the plate cylinder in view of the inkers and dampers which are associated therewith. Further, the ability to selectively, effectively place the application portion of the unit 3 in vertical position for movement, and in inclined or horizontal position (3*a*, 3*b*, respectively; FIG. 3) when applying a printing plate, permits movement of the handling unit 3 between printing stations, while still permitting movement towards the plate cylinders within the limited available space. Further, vertically staggered plate cylinders can be automatically applied with printing plates.

FIG. 3 illustrates, in a highly simplified and schematic representation, the arrangement which permits application of printing plates to the plate cylinders 105, 111, 106, 112 of neighboring printing stations 101, 102, respectively, by means of a single handling apparatus 3. As shown at the position 3*b*, the apparatus has applied a printing plate on cylinder 111 and the roller 22 is rolling the plate on the plate cylinder 111. The suction head 19 is shown schematically, and removed from the cylinder 111. In the position 3*a*, the suction head is in engagement with the plate cylinder 105 either for application of a new plate on plate cylinder 105 or removal of an old plate, for example after the operation in the position shown at 3*b* is completed. For ease of illustration, both positions are shown in full-line representation, to prevent confusion, since the same apparatus is involved.

Various changes and modifications may be made within the scope of the inventive concept.

We claim:

1. Automatic printing plate attachment system to apply a selected printing plate (20) on a selected plate cylinder (104, 105, 106, 107, 108, 109) of a rotary printing machine (101, 102), said system having a storage container (1);

a handling apparatus (3) including gripping means (19) thereon for removing a selected printing plate from the storage container and applying it to a selected plate cylinder and, respectively, removing an old printing plate from the cylinder and returning it to said storage container; and guide path means (4) for guiding movement of the handling apparatus in a guide path essentially parallel to the axis of rotation of the plate cylinder, comprising, in accordance with the invention, movable carriage means (1*a*) supporting said storage container (1), said storage container retaining a plurality of printing plates (20); and wherein said carriage means (1*a*) is movable in a carriage path (2, 2*b*) which extends at an essentially right angle to said guide path (4).

2. The system of claim 1, wherein said carriage path (2) includes rails on which said carriage means (1*a*) is movable.

3. The system of claim 1, wherein a guide system control means (2*a*) is provided radiating guide signals (2*c*) for guiding said carriage means (1*a*) on said guide path.

4. The system of claim 1, including a guide system control means (2*a*) including transmission means (2*c*) for transmitting a path control program to said carriage means (1*a*).

5. The system of claim 4, wherein said program is changeable during movement of the carriage means.

6. The system of claim 1, wherein said handling apparatus (3) comprises a base or chassis (7) including two relatively rotatable elements (5, 6), rotatable about a vertical axis.

7. The system of claim 6, including movable support means (8) for supporting said base or chassis (7) for movement along said guide path (4).

8. The system of claim 7, wherein said support means comprises rolls or wheels (8).

9. The system of claim 1, wherein said handling apparatus includes a plate holding means (17) for holding a printing plate;

a telescopic drive (25) which is coupled to said plate holding means for, respectively, projecting and retracting said plate holding means;

a rocking or tilting carrier (14) supporting said telescopic drive (25) for rocking or tilting movement about a horizontal tilting axis (13), the spacing between the plate holding means (17) and the rocking or tilting carrier (14) being controllably changeable by said telescopic drive (25); and vertically adjustably movable support legs (9) supporting said rocking or tilting carrier at a selected level above said guide path (4).

10. The system of claim 1, wherein said handling apparatus (3) includes a pressure roller (22) engageable with a printing plate which is being applied to a printing plate cylinder, for rolling the printing plate on the cylinder.

11. The system of claim 9, wherein said handling apparatus (3) includes a pressure roller (22) engageable with a printing plate which is being applied to a printing plate cylinder, for rolling the printing plate on the cylinder.

12. The system of claim 1, wherein said handling apparatus includes a plate holding means (17), said plate holding means comprising a rotary drive (21) and suction grippers coupled for rotary movement to said rotary drive.

13. The system of claim 9, further including suction grippers (19) and a rotary drive coupled to said suction grippers for rotatably moving the suction grippers, said suction grippers forming part of said plate holding means (17).

* * * * *